United States Patent [19]

Camm et al.

[11] Patent Number: 4,700,102

[45] Date of Patent: Oct. 13, 1987

[54] HIGH INTENSITY RADIATION APPARATUS HAVING VORTEX RESTRICTION MEANS

[75] Inventors: David M. Camm; Arne Kjørvel; Nicholas P. Halpin, all of Vancouver; Anthony J. D. Housden, North Vancouver, all of Canada

[73] Assignee: Vortek Industries, Ltd., Vancouver, Canada

[21] Appl. No.: 812,977

[22] Filed: Dec. 24, 1985

[30] Foreign Application Priority Data

Dec. 24, 1984 [CA] Canada ..... 470997

[51] Int. Cl.[4] ..... H01J 61/52

[52] U.S. Cl. ..... 313/24; 313/35; 313/231.51; 313/231.71

[58] Field of Search ..... 313/231.51, 231.61, 313/231.71, 22, 24, 35, 44, 570

[56] References Cited

U.S. PATENT DOCUMENTS 3,292,028 12/1966 Van Ornum ..... 313/35 X
3,366,815 1/1968 Anderson ..... 313/231.71 X
3,405,305 10/1968 Winzeler et al. ..... 313/22 X
4,027,185 5/1977 Nodwell et al. ..... 313/35

*Primary Examiner*—David K. Moore
*Assistant Examiner*—K. Wieder
*Attorney, Agent, or Firm*—John R. Uren

[57] ABSTRACT

A high intensity radiation source. A liquid vortex wall is formed on the inside surface of an arc chamber to restrict the diameter of an arc generated between electrodes. The liquid vortex wall is obtained by utilizing a vortex generating means which includes an annular restriction through which the liquid must pass prior to entering the arc chamber. The annular restriction is of a dimension sufficient to allow adequate pressure and velocity throughout the arc chamber and to reduce or eliminate flow irregularities which could be transmitted to the liquid wall in the arc chamber. A nozzle may provide for establishment of the required axial vortex flow motion of both the liquid and gas while the liquid and gas are physically separated prior to their entrance to the arc chamber. A discharge chamber adjacent the arc chamber is tapered smoothly to prevent flow disruptions and fin means on the electrode is provided to reduce gas and liquid flow in the opposite direction to that normally occurring in the arc chamber.

12 Claims, 2 Drawing Figures

HIGH INTENSITY RADIATION APPARATUS HAVING VORTEX RESTRICTION MEANS

INTRODUCTION

This application relates to a high intensity radiation source, and more particularly, to improvements in cooling and electrode life of such high intensity radiation sources.

BACKGROUND OF THE INVENTION

In U.S. Pat. No. 4,027,185 (Nodwell et al.) granted May 31, 1977, one of the inventors being common to the present invention, there is described a high intensity radiation source. This reference describes a novel method and apparatus used to produce a high intensity radiation source with an efficient cooling system to increase electrode life. The technique includes the steps of giving a liquid a vortexing motion to form a liquid wall interior of the arc chamber. The liquid cools the arc periphery and limits its diameter.

Improvements have been obtained, however, in increasing electrode life and arc efficiency. It was found in the apparatus described in the aforementioned U.S. Pat. No. 4,027,185 that the radial pressure gradient required within the vortex chamber to smooth out the flow patterns required a liquid pressure higher than desirable. Further, there was an undesirable dump chamber interaction between the vortexing gas and the liquid. This, too, caused liquid droplets to reach the region of the anode tip which was adverse to electrode life.

SUMMARY OF THE INVENTION

According to one aspect of the invention, there is disclosed an apparatus for producing a high intensity radiation comprising an elongated cylindrical arc chamber, first and second electrode means positioned coaxially within said arc chamber, liquid vortex generating means to inject liquid into said arc chamber to constrict the arc discharge by cooling the periphery of said arc discharge, means for injecting a gas having a vortex motion into said chamber through the interior of said cylindrical liquid wall, and annular vortex restriction means in said liquid vortex generating means being operable to decrease macro-turbulence of said liquid being injected into said arc chamber.

BRIEF DESCRIPTION OF THE SEVERAL VIEWS OF THE DRAWINGS

A specific embodiment of the invention, given by way of example only, will now be described with the use of drawings in which.

DESCRIPTION OF SPECIFIC EMBODIMENT

Figure 1:
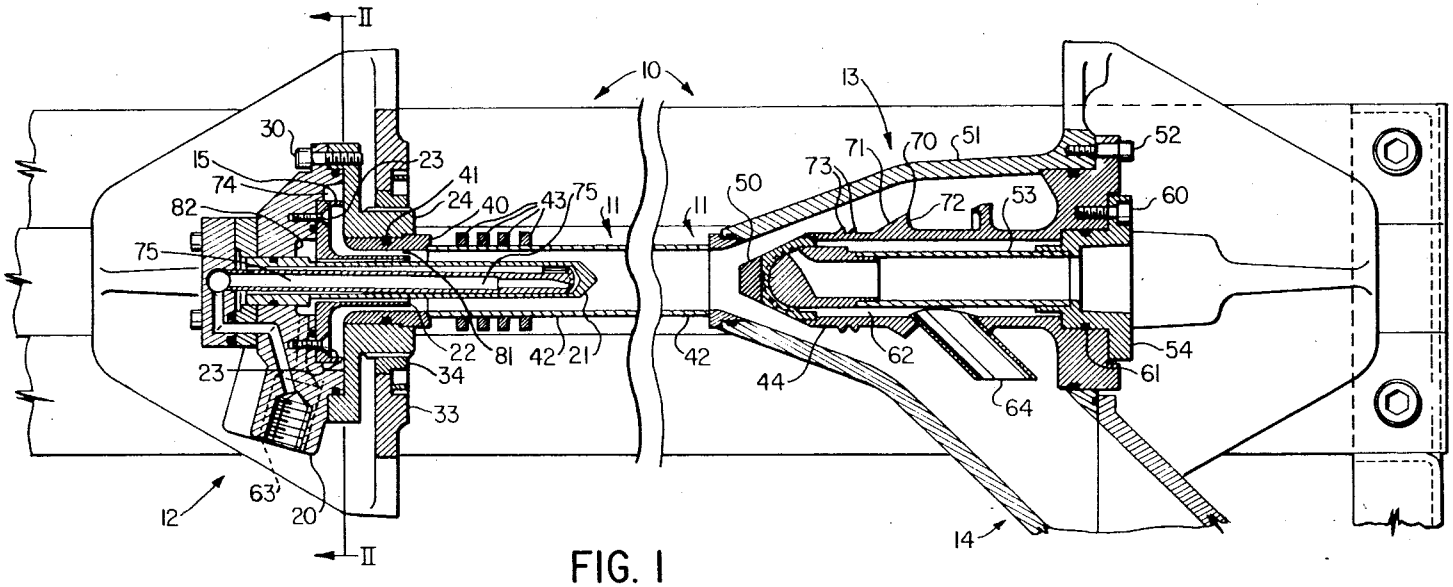
FIG. 1 is a cutaway view of a high intensity radiation source according to the invention.

A high intensity radiation source is generally shown in cutaway at 10 in FIG. 1. It comprises a quartz cylindrical arc chamber generally shown at 11, a cathode housing assembly generally shown at 12, an anode housing generally shown at 13 and a discharge or dump area generally shown at 14.

Support apparatus in the way of a starting circuit and power supply circuit is provided to initiate and maintain the arc discharge across the electrodes until sufficient current is provided to maintain the arc. Similarly, a liquid pump and heat exchanger for the coolant are provided and a gas pump to circulate the gas through the arc chamber will also be required. These requirements are described in the abovementioned U.S. Pat. No. 4,027,185, and the disclosure of that patent is hereby incorporated by reference.

The cathode housing assembly 12 includes a cathode housing 20 which holds a tungsten electrode 21. A nozzle 22 having an outer annulus 15 is mounted to cathode housing 20 (see also FIG. 2) using flathead screws 23 and a vortex chamber 24 is mounted to cathode housing 20 by capscrews 30. A ring nut 34 is mounted within cathode mounting bracket 33 and acts to retain vortex chamber 24 and the rest of the cathode housing assembly 12 in its operating position.

Figure 2:
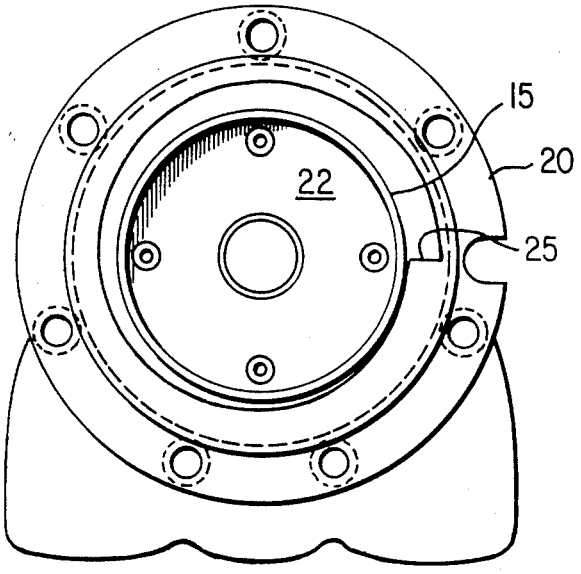
FIG. 2 is a cutaway view taken along II—II of FIG. 1.

The configuration of the cathode housing 20 and nozzle 22 when connected thereto is depicted in FIG. 2. The annular distance between the outer annulus of the nozzle 22 and the cavity 74 decreases around the circumference of the cavity 74. It is preferred that the rate of change of this volume be constant with the angular displacement from the water jet introduction point 25.

A tube insert 40 with an O-ring 41 is sealingly connected to the end of the quartz arc tube 42 and is mounted in vortex chamber 24. Spark arrestors 43 are positioned around the end of arc tube 42.

Referring to the opposite end of the arc chamber 11, the anode housing assembly 13 comprises an anode 44 having an anode tip 50. An expansion nozzle 51 encases the anode tip 50 and anode 44. The anode 44 and anode tip 50 are connected to expansion nozzle 51 using cap screws 52. The anode insert 53 is retained in an anode insert retainer 54 which is connected to anode 44 using cap screws 60. An O-ring 61 acts as a seal between the anode 44 and the anode insert retainer 54.

The expansion nozzle 51 contains no abrupt transition areas. Rather, it smoothly enlarges in a conical configuration until discharge area 14 is reached which dumps the liquid and gas into a dump chamber (not shown) where the liquid and gas separate. Both are pumped through suitable heat exchangers (not shown) and subsequently recirculated. An annular cooling chamber 62 is provided to cool the anode 44 and anode inset 53. The liquid is discharged through anode coolant exit nozzle 64 where it is passed to the dump chamber (not shown) for recirculation.

The anode 44 has a forward portion adjacent the expansion nozzle 51. A fin 70 is encountered intermediate the anode. Fin 70 surrounds the circumference of and is part of anode 44. While the forward portion 71 tapers smoothly rearwardly, the rearward portion 72 is concave in shape, both the forward and rearward configurations being for the purposes explained hereafter. A forward set of fins 73 is also provided of the same general configuration but smaller than the fin 70 located intermediate the anode 44.

OPERATION

In operation, a high current power supply (not shown) is connected across the electrodes 21, 50. A liquid pump and heat exchanger (not shown) provide liquid into the cathode housing 20. A stream of liquid cools the interior 75 of electrode 21. The cathode housing 20 (FIG. 2) emits a single stream of liquid at 25 on the periphery of the cavity 74 within which nozzle 22 is mounted. As best seen in FIG. 2, the water stream travels around the periphery of cavity 74 while the annular distance between the outside of cavity 74 and the outer annulus 15 steadily decreases as the circumferential distance is travelled. At the same time, the liquid is being expelled from the cavity 74 through the annular restriction between the outer annulus 15 and the vortex chamber 24. The annular restriction is of a width and valid distance sufficient to provide the required pressure and liquid quantity for the desired radial liquid motion such that macro-turbulence of the liquid is decreased. It has been found that for a water flow of five to twenty U.S. G.P.M., a suitable gap for a restricting radius of 1.75 inches is 0.006" to 0.015". Such dimensions also allow liquid irregularities to be removed such that the flow pattern of the liquid is smooth to inhibit the abovementioned unnecessary turbulence.

As the vortexing liquid leaves the vortex chamber 24, it encounters the separation cylinder 81 formed with nozzle 22. The separation cylinder 81 is formed so as to take a position substantially coinciding with the equilibrium surface of the water wall formed on the inside periphery of the arc chamber 11. The separation cylinder 81 provides physical restraint of the liquid wall surface until the axial flow of the liquid has been established which reduces the interaction of water particles with the vortexing gas.

Gas is simultaneously introduced through inlet 63 and a vortex of gas is established in cavity 82 by injecting gas tangentially into cavity 82. Although the gas would develop a vortex motion due to the vortexing of the liquid wall in the arc chamber, it is preferable to provide the gas with a tangential velocity. The vortexing gas is guided into the peripheral opening between the outside diameter of the cathode 21 and the inside diameter defined by the separation cylinder 81. Again, the physical constraint of the separation cylinder 81 allows for axial flow of the gas to be established thus reducing the possibility of interaction caused by turbulence of the gas and liquid.

Thus, the vortexing gas is guided by the separation cylinder 81 into the arc chamber where it travels to the anode 44. The vortexing liquid forms a liquid wall on the inside of the arc tube 42 and flows into the anode housing assembly 13. The expansion nozzle 51 of the anode housing assembly 13 tapers smoothly outwardly and has smooth transition areas to minimize turbulence in the liquid and gas flow. The liquid and gas mixture is discharged from the discharge area 14 to the dump chamber (not shown).

Unavoidable turbulence as the water and gas leave the expansion nozzle 51 will lead to liquid moving along the anode 44 towards the arc or from right to left as viewed in FIG. 1. This motion will be increased by fluctuations in the arc current that can cause momentary reversals of gas flow. If this liquid reaches the region of the anode tip 50, the liquid will vaporize and disassociate. This will result in thermal shocks to the electrode tip 50, which can significantly reduce electrode life. The arc itself will be cooled and may be extinguished.

To reduce this problem, fins 70, 73 are positioned to prevent the water from moving towards the anode tip 50. The fins 70, 73 will entrap deviant liquid particles and discharge them with the liquid. The fins 70, 73 have a forward configuration which will not inhibit the movement of liquid away from the anode tip 50 and a rearward configuration that will inhibit liquid from moving towards the anode tip 50. Thus, forward and rearward surfaces 71, 72 may take convex and concave configurations, respectively.

Following discharge of the liquid and gas mixture through the discharge area 14, the liquid and gas are recirculated directly or through respective heat exchangers (not shown) to respective inlets in the cathode housing assembly 12.

Many changes to the specific apparatus described are envisioned which still lie within the scope of the invention. For example, the separation cylinder 81 and nozzle 22 could, of course, be separate pieces rather than being machined from a single piece of material as described. The anode 44 could use any of several different configurations to prevent liquid particles from travelling towards the anode tip 50. The annular restriction depicted, while being satisfactory under the conditions cited, may be adjusted under different operating conditions.

In accordance with the foregoing description, the specific embodiments described should be construed as illustrative only and not as limiting the scope of the invention as described in the accompanying claims.

The embodiments of the invention in which an exclusive property or privilege is claimed are defined as follows:

1. An apparatus for producing a high intensity radiation comprising an elongated cylindrical arc chamber, first and second electrode means positioned coaxially within said arc chamber, liquid vortex generating means to inject liquid into said arc chamber to constrict the arc discharge by cooling the periphery of said arc discharge, means for injecting a gas having a vortex motion into said chamber through the interior of said cylindrical liquid wall, and annular vortex restriction means in said liquid vortex generating means being operable to decrease the macro-turbulence of said liquid being injected into said arc chamber.

2. Apparatus as in claim 1 wherein said liquid vortex generating means comprises a liquid injector means and cavity means around the outer periphery of said annular vortex restriction means.

3. Apparatus as in claim 2 wherein the cross-sectional area of said cavity means decreases directly with respect to the angular distance around said cavity from said liquid injector means.

4. Apparatus as in claim 2 wherein said annular vortex restriction means defines a circumferential opening adjacent a vortex chamber means of said liquid vortex generating means.

5. Apparatus as in claim 4 wherein said opening is substantially constant about the circumference of said annular vortex restriction means adjacent said vortex chamber means.

6. Apparatus as in claim 5 and further comprising nozzle means extending from said liquid vortex generating means along said first electrode, the outside periphery of said nozzle means being substantially conterminus with the equilibrium surface of said cylindrical liquid wall, said distance being of a length to allow vortex action of said liquid and gas to be substantially established.

7. Apparatus for producing a high intensity radiation comprising an elongated cylindrical arc chamber, first and second electrodes mounted coaxially at opposite ends of said arc chamber, liquid vortex generating means to generate a cylindrical liquid wall on the outside periphery of said arc chamber, from said first to said second electrodes, gas injection means to inject a gas into said arc chamber within said cylindrical liquid wall and nozzle means extending from said liquid vortex generating means a distance along said first electrode, the outside periphery of said nozzle means being substantially conterminus with the equilibrium surface of said cylindrical liquid wall, said distance being of a length to allow vortex action of said liquid and gas to be substantially established.

8. Apparatus as in claim 7 wherein said inert gas is injected into said arc chamber between the inside diameter of said nozzle means and the outside circumference of said first electrode and said liquid is injected into said arc chamber outside said nozzle means.

9. Apparatus for producing a high intensity radiation comprising an elongated cylindrical arc chamber, first and second electrodes mounted coaxially at opposite ends of said arc chamber, liquid vortex generating means adjacent said first electrode to create a liquid vortex wall around the inside cylinder of said arc chamber, gas injection means to inject gas into said arc chamber between said first and second electrodes, said gas having a vortex action from said first to said second electrode and liquid and gas receiving means adjacent said second electrode, said second electrode having at least one fin mounted thereon, said fin extending in and defining a relatively unobstructed pathway in the direction of liquid and gas flow within said arc chamber and said fin defining an obstructed pathway to the liquid and gas flow when said liquid and gas are moving in a direction opposite to said liquid and gas flow within said arc chamber.

10. Apparatus as in claim 9 wherein said liquid and gas receiving means comprises an expansion chamber smoothly expanding from a primary receiving area to a discharge area.

11. Apparatus as in claim 10 wherein said anode has a first set of relatively small fins near the tip of said anode and a second set of relatively larger fins near the intermediate portion of said anode.

12. Apparatus as in claim 11 and further comprising an exit nozzle mounted in said anode and operable to discharge liquid into said discharge area.

* * * * *